US005268168A

United States Patent [19]

Katayama et al.

[11] Patent Number: 5,268,168

[45] Date of Patent: Dec. 7, 1993

[54] ANTIBACTERIAL AND DEODORANT PROCESSING AGENT AND PROCESSING METHOD USING SAME

[75] Inventors: Matsuko Katayama; Kimiaki Yasuda, both of Fukui; Hidehi Takebe, Kanagawa; Katsuharu Iinuma, Kanagawa; Toshio Yoneta, Kanagawa, all of Japan

[73] Assignees: Sakai Engineering Co., Ltd., Fukui; Meiji Seika Kaisha, Ltd., Tokyo, both of Japan

[21] Appl. No.: 654,989

[22] Filed: Feb. 14, 1991

[30] Foreign Application Priority Data

Feb. 19, 1990 [JP] Japan ..... 2-36182
Mar. 26, 1990 [JP] Japan ..... 2-73237

[51] Int. Cl.[5] ..... A61L 9/01

[52] U.S. Cl. ..... 424/76.1; 424/76.3; 424/76.8; 424/404

[58] Field of Search ..... 424/78, 76.1, 78.09, 424/78.08, 76.3, 76.8, 404; 514/40, 41; 604/266; 536/13.8, 22, 16.6, 13.2, 16.8, 13.3, 13.6, 13.7, 13.9, 14; 8/115.5, 495, 606, 115.66, 181, 184, 196

[56] References Cited

U.S. PATENT DOCUMENTS 2,830,011 4/1958 Parker ..... 536/13.2
3,350,387 10/1967 Vanderhaeghe ..... 536/13.2
3,940,382 2/1976 Umezawa et al. ..... 536/13.8
4,199,572 4/1980 Schroder et al. ..... 514/41
4,496,363 1/1985 DeFilippi ..... 8/196
4,708,870 11/1987 Pardini ..... 424/78
4,895,566 1/1990 Lee ..... 604/266

FOREIGN PATENT DOCUMENTS 0147618 11/1983 European Pat. Off. .
0387586 9/1990 European Pat. Off. .
2383963 3/1978 France .
1430851 7/1986 France .

OTHER PUBLICATIONS

Data Base WPIL, accession No. 74,27616v(15), Derwemt Publications Ltd., London GB and JP-A-48 029 402 ((Kaya-) Kayaky Antibiotics Res.) 14 Apr. 1973.
Bulleting De La Societe Chimque De France, No. 7, 1969 Paris FR pp. 2391-2394.
Derwent Japanese Patents Report, Section Pharmaceuticals, week R39, Nov. 20, 1970, Derwent Publications Limited, London, GB, p. 3, No. 70854R and JP-A-7 030 815 (Biseibutsu Kagaku Kenkyukai FNDN) Oct. 6, 1970.

*Primary Examiner*—Thurman K. Page
*Attorney, Agent, or Firm*—Sughrue, Mion, Zinn, Macpeak & Seas

[57] ABSTRACT

An antibacterial and deodorant processing agent for the sanitary processing, in particular, for the sanitary processing of a fiber material having a hydrophobic surface, which comprises a derivative of an aminoglycoside antibiotic, and a method for the antibacterial and deodorant processing of a fiber material having a hydrophobic surface with the use of said antibacterial and deodorant processing agent.

17 Claims, No Drawings

ANTIBACTERIAL AND DEODORANT PROCESSING AGENT AND PROCESSING METHOD USING SAME

FIELD OF THE INVENTION

The present invention relates to aminoglycoside antibiotic derivatives which can be used for antimicrobial and deodorant processing of a fiber product having hydrophobic surface in order to provide the fiber product with antibacterial and deodorant properties, to inhibit the growth of harmful microorganisms on the fiber product to thereby prevent deterioration of the fiber product caused by harmful microorganisms as well as a processing method using the same.

The aminoglycoside antibiotic derivatives according to the present invention can be applied to the antimicrobial processing of products other than fiber products, for example, package materials and industrial materials. The derivarives enables the processing of these materials at a high safety compared with known processing agents.

BACKGROUND OF THE INVENTION

The conventional antibacterial processing agents used for the processing of fiber materials are as follows:

(1) silicon-containing quaternary ammonium salts;
(2) a mixture of a silicon-containing quaternary ammonium salt and undecylenic acid;
(3) a mixture of benzalkonium chloride and undecylenic acid;
(4) a mixture of undecylenic acid and anionic and nonionic surfactants;
(5) polyoxyethylene trialkylammonium chlorides;
(6) benzalkonium chloride;
(7) copper sulfate (applicable to acrylic fibers); and
(8) polyhexamethylene biguanidine hydrochloride.

Recently, antibacterial and deodorant processing agents comprising silicon-containing quaternary ammonium salts and polyoxyethylene trialkylammonium chlorides as the major components have been frequently employed.

It is known that aminoglycoside antibiotics are effective as an antibacterial and deodorant processing agent for fibers and other materials (EP-A-0 387 586).

However these compounds have the following disadvantages.

(1) They are liable to come off during washing.
(2) The processing of a fiber product is generally performed at the final finishing stage of dyeing process. When the processing is effected at some other stage before the final finishing stage, the processing agent comes off in the course of the process. As a result, the final product is given no antibacterial property.
(3) Some processing agents cause a change in the color tone of the product (in particular, a decrease in whiteness).
(4) The antibacterial property thus provided is poor.

A polyoxyethylene trialkylammonium chloride shows somewhat affinity for a hydrophobic material due to properties of its terminal group. However, since it cannot be bound to a hydrophobic material, this compound comes off during washing to thereby seriously deteriorate antibacterial and deodorant properties provided for the material.

In order to overcome this disadvantage, there has been developed a silicon-containing quaternary ammonium salt. In a silicon-containing quaternary ammonium salt, an alkoxysilane group is introduced into the terminal of a quaternary ammonium salt which contributes to an antibacterial effect. The alkoxysilane fuctions to prevent the silicon-containing quaternary ammonium salt from coming off during washing.

This silicon-containing quaternary ammonium salt can adhere to the surface of a material to be processed by forming a covalent bond between the alkoxysilane and a hydroxyl group located on the surface of the material and further allowing the silicon-containing quaternary ammonium salt molecules to be graft-polymerized thereon to each other to thereby form a thin film on the surface of the material. Thus the silicon-containing quaternary ammonium salt firmly adheres to the material. In the case of a material having no hydroxyl groups, therefore, the binding force and the adhesion force between the silicon-containing quaternary ammonium salt and the material are so weak that the silicon-containing quaternary ammonium salt is easily liberated and removed when a physical force (e.g. rubbing) is applied.

The aminoglycoside antibiotics are strongly adsorbed by a material having a hydrophilic surface, presumedly through a hydroxyl group. Thus it has a high fastness to washing. However the aminoglycoside antibiotics neither specifically adsorb a material having hydrophobic surface nor have fastness to washing.

SUMMARY OF THE INVENTION

An object of the present invention is to provide an antibacterial and deodorant processing agent which can provide an material to be processed, particularly one having a hydrophobic surface, with sustained antibacterial and deodorant properties without coming off during washing, which is difficult in the processing with the use of known antibacterial and deodorant processing agents, and which shows elevated applicability.

Further, the desired agent is required to have the following properties.

(1) It shows extremely low oral and percutaneous absorption.
(2) It is highly safe to human body.
(3) It is liable to be decomposed without remaining in the environment. When liberated in the environment, it is decomposed naturally within an extremely short period of time.
(4) It is stable to heat. Its antibacterial activity is never decreases at least at 200° C. which is seemed to be the upper limit of temperature in common processing of fibers.

Although aminoglycoside antibiotics satisfies all of these four requirements, it shows only limited adsorption on a material having hydrophobic surface.

As a result of extensive studies, it was found that the above object can be attained by a preparation comprising a derivative of an aminoglycoside antibiotic in which one or more primary amino groups of the aminoglycoside antibiotic are converted into a Schiff base or a reduced product, namely an N-alkyl derivative, of the Schiff base compound.

DETAILED DESCRIPTION OF THE INVENTION

The antibacterial and deodorant processing agent for processing of fiber products is usually used at the final stage of the processing of the dyeing process together with a conventional finishing agent.

The finishing stage, in which antistatic and texture-improving treatments are usually performed, comprises the steps of diluting or dissolving processing agents so as to give an appropriate concentration, immersing the textile to be treated therein, squeezing the textile to control the amounts of the adsorbed processing agents, and drying the textile. An antibacterial and deodorant processing agent is appropriately diluted and then combined with the aqueous solution of the other processing agents for practice of the processing treatment. Conventionally, the processing is effected in an aqueous system and the processing agents are either water soluble materials or resin emulsions dispersed in an aqueous solvent. Thus, novel chemicals which have been developed as processing agents are also soluble in water or dispersible in water as well as conventional agents from the viewpoint of the easiness in handling.

In this method, it is easy to handle the processing agents and to practice the processing and a texture-improver and/or an antistatic agent can be applied to the material to form a film of these agents on the surface of the material even after drying the material. However, in the case of a material having hydrophobic surface or carrying no functional group on the surface, it limitedly interacts with the film-forming substances. Therefore, it is required to maintain the contact of the surface of the material with the film through the strength of the film per se in order to achieve a high film stability. In this case, when the concentrations of the processing agents raised to elevate the amount of the agents adhered to the material, it is unavoidable that the texture of the processed product is changed.

A silicon-containing quaternary ammonium salt, which reacts with a hydroxyl group on the surface of a material as described above, can be used in a relatively mild treatment in the dyeing finishing process, for example, in the water-washing stage subsequent to dyeing.

In the case of a material having no hydroxyl group on the surface, namely, having no group reactive with a silicon-containing quaternary ammonium salt, however, the fixation via a covalent bond cannot be effected. Therefore, there is no choice but to employ the conventional method in which the agent is used in the final finishing stage to form a film on the surface of the material.

When the derivative of aminoglycoside antibiotic according to the present invention is used in the dyeing stage of the processing of a material having hydrophobic surface (in particular, one to be dyed with a dispersed dye), antibacterial and deodorant properties are provided for the material as well as a high fastness to washing.

In a common dyeing process, the processing is performed under relatively severe conditions so as to sufficiently diffuse a dye into fibers. The processing conditions are determined so that each fiber material can sufficiently swell and the dye can easily diffuse within the material. In the case of a polyester fiber, for example, since sufficient dyeing cannot be achieved under atmospheric pressure (below 100° C.), dyeing is performed under elevated pressure at a high temperature (around 130° C.).

Under these conditions, it is considered that the fiber swells in water sufficient to allow the dye to diffuse therein and that the crystal structure of the polymer is considerably loosened. If an antibacterial and deodorant processing agent is used together with the dye and behaves similar to the dye, the antibacterial and deodorant processing agent might diffuse within the fiber and stably persist therein. Thus the antibacterial and deodorant processing properties of the material are expected to maintain.

An aminoglycoside antibiotic derivative in which one or more amino groups of the aminoglycoside antibiotic is converted into a Schiff base and a reduced product of the Schiff base compound can sufficiently withstand washing in practice when employed in a conventional manner, though a slight decrease in fastness to washing is observed.

The derivative of an aminoglycoside antibiotic of the present invention is described in detail below.

Among derivatives in which all amino groups are converted into Schiff bases, those having a high crystallinity can be isolated and then identified based on, for example, physical properties thereof. However it is almost impossible to isolate derivatives other than those mentioned above, in particular, each or a specific one of those prepared by using an aldehyde in an amount not enough for converting all amino groups into Schiff bases (it is presumed that 15 derivatives are obtained from an aminoglycoside antibiotic having 4 amino groups), in view of the stabilities of the Schiff bases. The processing agent of the present invention may be a mixture of such derivatives.

On the other hand, antibacterial activity of the derivative (per unit weight) is lowered as the molecular weight of the derivative increaes in proportion to an increase in the amount of the employed aldehyde. Namely, the antibacterial activity of Schiff base derivatives is proportional to the amount of the aminoglycoside antibiotic contained therein. Thus the effectiveness of each component depends exclusively on the aminoglycoside antibiotic contained therein. Therefore not the composition ratio of the components but the content of the aminosglycoside antibiotic is significant in the evaluation of the effectiveness thereof.

The process for producing the derivative according to the present invention is described below.

An aminoglycoside antibiotic is reacted with aldehyde in a solvent. The solvent may be selected from lower alkanols such as methanol and ethanol, tetrahydrofuran (THF), dioxane, methyl cellosolve and mixtures thereof with water. The solvent is used in an amount of 6 to 10 part by weight based on the weight of aminoglycoside antibiotic. The reaction can be carried out at room temperature for about 16 hours. When the reaction product thus obtained precipitates after the completion of the reaction, the precipitate is collected by filtration. When no precipitate is formed, the reaction mixture is concentrated and then extracted with, for example, ether or isopropyl ether (IPE) to thereby give the desired Shiff base derivative. Then the resulting derivative is reduced by adding a reducing agent such as $NaBH_4$, $NaCNBH_3$ or LiAlHg or a catalyst for catalytic reduction such as palladium to the reaction mixture. The reduction is carried out at room temperature for 10 minutes to 1 hour. The precipitate thus formed is collected by filtration and dried to obtain an N-alkyl derivative. The reducing agent may be added to the reaction mixture from the beginning. Aldehyde and the reducing agent are both used in an amount of 2 to 3 part by weight based on the weight of aminoglycoside antibiotic.

Examples of usable aldehydes include straight-chain aliphatic aldehydes represented by the formula, $CH_3(CH_2)_nCHO$ (n=0 to 16), such as acetaldehyde, butylaldehyde, heptaldehyde, dodecylaldehyde, tetradecylaldehyde and aromatic aldehydes such as benzaldehyde and derivatives thereof, e.g. anisaldehyde, salicylaldehyde, dimethoxybenzaldehyde, ethoxybenzaldehyde. Anisaldehyde and salicylaldehyde are preferably used.

Examples of usable aminogycoside antibiotics include neamine, neomycin, paromomycin, lividomycin, ribostamycin, kanamycin A, kanamycin C, tobramycin, panimycin, gentamicin A, gentamicin B, gentamicin C, gentamicin $C_{1a}$, gentamicin $C_2$, sisomicin, netilmicin, amikacin and streptomycin.

The antibacterial and deodorant processing agent according to the present invention is used in an amount of about 0.05 wt% based on the weight of the material to be treated. A concentration of the processing agent in the processing solution is adjusted to about 0.0025 wt%.

The derivative of the aminoglycoside antibiotic of the present invention is applicable not only to antibacterial and deodorant processing agents for the sanitary processing of fibers but also to antibacterial agents for non-aqueous coatings, resin emulsions, printing inks, rubbers, plastics, films, coated wires, oils and adhesives.

An antiseptic agent for metal processing is used in order to suppress or prevent various deteriorations caused by microorganisms including bacteria, fungi and yeasts grown in a metal processing oil or a water soluble engineering oil.

Microorganisms cause the evolution of an offensive odor, the formation of slime, the breakage of emulsion and rusting in industrial emulsions of water soluble engineering oils such as cutting oil, grinding oil, engineering oil and calendering oil. Thus the working environments and the properties of the emulsions are deteriorated and, further, engineering machines and materials to be processed are seriously affected. Examples of microorganisms causing these deteriorations are as follows.

(1) Escherichia coli;
(2) Klebsiella pneumoniae;
(3) Proteus vulgaris;
(4) Pseudomonas aeruginosa;
(5) Pseudomonas oleovorans;
(6) Salmonella typhosa; and
(7) Staphylococcus aureus.

Among these microorganisms, it is considered that *Pseudomonas aerucinosa* and *Pseudomonas oleovorans* causes serious deteriorations in particular.

To further illustrate the present invention, the following non-limiting Examples will be given.

EXAMPLE 1

A polyester thread fabric (twill) having hydrophobic surface was dyed and simultaneously treated with N-anisylideneneamine as prepared in Preparation Example 1 below in the following manner to perform the antibacterial and deodorant processing.

To 200 ml of tap water, were added 0.1 g of Nicca Sunsolt RM340 (manufactured by Nicca Chemical Co., Ltd.) as a leveling agent, 0.2 g SE Buffer 301 (manufactured by Sakai Engineering Co., Ltd.) as a dyeing acid, 0.05 g (corresponding to 0.5% of the test fabric) of Dianix Blue FBL (manufactured by Mitsubithi Kasei Corporation) as a dye and 0.005 g (corresponding to 0.05% of the test fabric) of N-anisylideneneamine. The dyeing solution thus prepared was poured into a dyeing pot (manufactured by Texam Co., Ltd., for mini-color dyeing test machine) and 10 g of the polyester thread fabric (twill), which had been scoured, was added thereto.

The resulting test pot was introduced into a dyeing test machine (manufactured by Texam Co., Ltd., mini-color dyeing test machine) and the temperature was elevated from 70° C. at a rate of 1° C. per minute. When the temperature reached 130° C., it was maintained at this level for 30 minutes. Then it was cooled to room temperature and the test fabric was taken out.

The antibacterial property of the obtained test fabric was evaluated in accordance with a bacterial count method as described below.

Bacterial cell count method

*Staphylococcus aureus* IFO 12732 is incubated at 35° to 37° C. for 24 hours on the plain hurt infusion agar medium and then sterilized normal bouillon medium is inoculated with a loopful of the above bacterial cells followed by shake culture at 35° to 37° C. for 6 to 10 hours. The culture medium is decimally diluted with a sterilized physiological saline to adjust a cell density to $5\text{–}30\times10^5$ cells/ml. The test fabric and control fabric are each placed into a culture vial and autoclaved. Then, the culture is applied on to the fabric and incubated at 35°–37° C. for 18 hours. After completion of culture, a determined amount of sterilized physicological saline is added to the vial to obtain cell suspension and serial dilution is made. Each dilution of cell suspension is cultured at 35°–37° C. for 24 to 48 hours and the number of colonies is counted. The bacterial cell count is determined by multiplying the number of colonies into a dilution factor. The deviation of gain or loss is calculated by the following equation.

$$\text{deviation of gain or loss} = \log\frac{B}{A} - \log\frac{C}{A}$$

A: average cell count on the control fabric immediately after inoculation of the cell culture
B: average cell count on the control fabric after 18 hr-incubation
C: average cell count on the test fabric after 18 hr-incubation The antibacterial treatment is regarded as effective when $$\log\frac{B}{A} > 2.$$

The test fabric was examined for fastness to washing by a washing test in accordance with the following method.

Wasing test

Water of 40° C. is added to a domestic electric washing machine and a synthetic detergent for clothing is added thereto to a concentration of 2 g/l. The test fabric is put into the washing solution to a bath ratio of 1:30. The washing machine is worked for 5 minutes and the fabric is dehydrated with a dryer. The fabric is rinsed with water of ordinary temperature in the same bath ratio for 2 minutes and dehydrated. The rinsing is repeated in the same manner. Then, the fabric is hung to dry so as not to get the sun.

The thus-obtained fabric is examined for antibacterial property in accordance with the above-described bacterial cell count method. The antibacterial treatment is regarded as effective when $$\log \frac{B}{A} > 2$$

and $$\log \frac{B}{C} > 1.6.$$

The results are shown in Table 1.

TABLE 1

| Agent (% 0.W.F.*) | No. of washing | Cell count after 18 hours | Deviation of Gain or loss | Effect |
|---|---|---|---|---|
| 0 | 0 | $8.4 \times 10^8$ | | |
| 0.1 | 0 | $<2.0 \times 10^5$ | 3.62 | Yes |
| 0.1 | 10 | $<2.0 \times 10^5$ | 3.62 | Yes |

Note:
*On the weight fabric Inoculated cells: $1.1 \times 10^6$

These results show that the antibacterial and deodorant processing can be performed simultaneously with dyeing with the use of the derivative of the present invention, and that satisfactory antibacterial effects can be obtained as well as a high fastness to washing.

EXAMPLE 2

The antibacterial and deodorant processing was performed at the final finishing stage, similar to conventional cases, using N-anisylideneneamine in the following manner.

0.01 g of N-anisylideneneamine was added to 100 ml of Turkey red oil and the mixture was emulsified to serve as a processing solution. Then a polyester thread fabric (twill) test piece (30 cm×40 cm) was immersed in the resulting processing solution. This moistened test fabric was squeezed with a rubber roll so that the weight of the processing solution contained in the fabric reached 80% of the weight of the test fabric. After hot-air drying at 110° C. for 3 minutes, the test fabric was heat-treated at 180° C. for 1 minute.

The test fabric thus obtained was subjected to a antibacterial test and a test for fastness to washing in the same manner as in Example 1.

The results are shown in Table 2.

TABLE 2

| Agent (wt %) | No. of washing | Cell count after 18 hours | Deviation of Gain or loss | Effect |
|---|---|---|---|---|
| 0 | 0 | $6.8 \times 10^8$ | | |
| 0.01 | 0 | $<2.0 \times 10^5$ | 3.53 | Yes |
| 0.01 | 10 | $<1.8 \times 10^6$ | 2.58 | Yes |

Note:
Inoculated cells: $1.3 \times 10^6$

These results show that the antibacterial and deodorant processing can be performed at the final finishing stage, similar to conventional cases, with the use of the derivative of the present invention and that satisfactory antibacterial effects can be obtained as well as a substantially high fastness to washing, though somewhat inferior to the effect obtained in Example 1.

EXAMPLE 3

The antibacterial effect of the N-anisylideneneamine on a metal procession oil was examined using a model emulsified calendering oil having the following composition.

| | |
|---|---|
| lard | 15 wt % |
| Tween 80 (polyoxyethylene sorbitan monooleate) | 4 |
| Span 80 (sorbitan monooleate) | 1 |
| mahogany soap | 2 |
| calcium oleate | 1 |
| liquid paraffin | 77 |
| Total | 100 wt % |

One gram of the above model oil was mixed with 100 ml of ion-exchanged water.

The resulting mixture was poured into a 500 ml Erlenmeyer flask and then 1 ml of a viable bacterial cell suspension ($10^8$ cells/ml) was added thereto. As the test strain, *Staphylococcus aureus* IFO 12732 or *Escherichia coli* IFO 3972 was used. This test solution was incubated at 30° C. for 1 month.

The results are shown in Table 3.

TABLE 3

| Test Strain | Conc. of agent (wt %) | Cell density (cells/ml) beginning | after 1 week | after 1 month | Effect |
|---|---|---|---|---|---|
| *S. aureus* | 0 | $1.4 \times 10^6$ | $5.6 \times 10^8$ | $2.4 \times 10^8$ | |
| " | 0.01 | $1.7 \times 10^6$ | $3.8 \times 10^2$ | $2.0 \times 10^2$ | Yes |
| *E. coli* | 0 | $1.2 \times 10^6$ | $8.4 \times 10^7$ | $3.6 \times 10^8$ | |
| " | 0.01 | $1.4 \times 10^6$ | $6.5 \times 10^4$ | $7.2 \times 10^3$ | Yes |

As shown in Table 3, it is found that the antibacterial and deodorant processing agent is applicable to an antibacterial agent for metal processing oils.

PREPARATION EXAMPLE 1

2.72 g of p-anisaldehyde was added to 32 ml of a 50% methanol aqueous solution of 3.22 g of neamine. The mixture was stirred at room temperature for overnight. The precipitate thus formed was collected by filtration and dried to obtain 3.90 g of an N-anisylideneneamine.

PREPARATION EXAMPLE 2

2.72 g of p-anisaldehyde and 1 g of $NaBH_4$ were successively added to 32 ml of a 50% methanol aqueous solution of 3.22 g of neamine. The mixture was stirred at room temperature overnight. The precipitate thus formed was collected by filtration and dried to give 1.5 g of a reduction product of N-p-methoxybenzylneamine.

PREPARATION EXAMPLE 3

0.6 g of 3',4'-dideoxykanamycin B was dissolved in a mixture of 12 ml of water and 6 ml of ethanol. Then 0.81 ml of p-anisaldehyde and 6 ml of dioxane were added thereto and the mixture was stirred at room temperature overnight. The precipitate thus formed was collected by filtration, washed with ether and dried. Thus 1.2 g of an N-anisylidene-3',4'-dideoxykanamycin B was obtained.

PREPARATION EXAMPLE 4

0.6 g of 3',4'-dideoxykanamycin was dissolved in a mixture of 12 ml of water and 6 ml of ethanol. Then 0.67 ml of salicylaldehyde was added thereto and the mixture was stirred overnight at room temperature. After distilling off the solvent, ether was added to the oily residue. The solid thus obtained was collected by filtration and dried to give 1.3 g of 3',4'- dideoxykanamycin B.

While the invention has been described in detail and with reference to specifc embodiments thereof, it will be apparent to one skilled in the art that various changes and modifications can be made therein without departing from the spirit and scope thereof.

What is claimed is:

1. A preparation, useful in disinfecting and deodorizing a a fabric or the individual threads thereof each having a hydrophobic surface, comprising a Schiff base derivative of an aminoglycoside antibiotic, wherein one or more amino groups of the aminoglycoside antibiotic is converted into a Schiff base or a Schiff base substituted with an N-alkyl group.

2. An antibacterial and deodorant processing preparation as claimed in claim 1, wherein said Schiff base derivative is a Schiff base compound in which one or more primary amino groups of said aminoglycoside antibiotic are bound to an aliphatic aldehyde or an aromatic aldehyde.

3. An antibacterial and deodorant processing preparation as claimed in claim 1, wherein said Schiff base derivative is an N-alkyl derivative of a Schiff base compound in which one or more primary amino groups of said aminoglycoside antibiotic are bound to an aliphatic aldehyde or an aromatic aldehyde.

4. An antibacterial and deodorant processing preparation as claimed in claim 1, wherein said aminoglycoside antibiotic is selected from the group consisting of neamine, neomycin, paromomycin, lividomycin, ribostamycin, kanamycin A, kanamycin C, tobramycin, panimycin, gentamicin A, gentamicin B, gentamicin C, gentamicin $C_{1a}$, gentamicin $C_2$, sisomicin, netilmicin, amikacin and streptomycin.

5. An antibacterial and deodorant processing preparation as claimed in claim 2, wherein said aliphatic aldehyde is represented by the formula, $CH_3(CH_2)_nCHO$, wherein n is an integer of from 0 to 16.

6. An antibacterial and deodorant processing preparation as claimed in claim 3, wherein said aliphatic aldehyde is represented by the formula, $CH_3(CH_2)_nCHO$, wherein n is an integer of from 0 to 16.

7. An antibacterial and deodorant processing preparation as claimed in claim 2, wherein said aromatic aldehyde is selected from the group consisting of anisaldehyde, salicylaldehyde, benzaldehyde, dimethoxybenzaldehyde and ethoxybenzaldehyde.

8. An antibacterial and deodorant processing preparation as claimed in claim 3, wherein said aromatic aldehyde is selected from the group consisting of anisaldehyde, salicylaldehyde, benzaldehyde, dimethoxybenzaldehyde and ethoxybenzaldehyde.

9. A method for disinfecting and deodorizing a fabric or the individual threads thereof, each having a hydrophobic surface, comprising treating the fabric or the individual threads thereof with a Schiff base derivative of an aminoglycoside antibiotic, wherein one or more amino groups of the aminoglycoside antibiotic is converted into a Schiff's base or a Schiff's base substituted with an N-alkyl group, wherein the fabric or the individual threads thereof are heated so as to allow said Schiff base derivative of an aminoglycoside antibiotic to diffuse into said fabric or the individual threads thereof, and then said fabric or the individual threads thereof are cooled so as to obtain said disinfected and deoderized fabric or the individual threads thereof.

10. An antibacterial and deodorant processing method as claimed in claim 9, said Schiff base derivative is a Schiff base compound in which one or more primary amino groups of said aminoglycoside antibiotic are bound to an aliphatic aldehyde or aromatic aldehyde.

11. An antibacterial and deodorant processing method as claimed in claim 9, wherein said Schiff base derivative is an N-alkyl derivative of a Schiff base compound in which one or more primary amino groups of said aminoqlycoside antibiotic are bound to aliphatic aldehyde or aromatic aldehyde.

12. An antibacterial and deodorant processing method as claimed in claim 9, wherein said aminoglycoside antibiotic is selected from the group consisting of neamine, neomycin, paromomycin, lividomycin, ribostamycin, kanamycin A, kanamycin C, tobramycin, panimycin, gentamicin A, gentamicin B, gentamicin C, gentamicin $C_{1a}$, gentamicin $C_2$, sisomicin, netilmicin, amikacin and streptomycin.

13. An antibacterial and deodorant processing method as claimed in claim 10, wherein said aliphatic aldehyde is represented by the formula, $CH_3(CH_2)_nCHO$, wherein n is an integer of from 0 to 16.

14. An antibacterial and deodorant processing method as claimed in claim 11, wherein said aliphatic aldehyde is represented by the formula, $CH_3(CH_2)_nCHO$, wherein n is an integer of from 0 to 16.

15. An antibacterial and deodorant processing method as claimed in claim 10, wherein said aromatic aldehyde is selected from the group consisting of anisaldehyde, salicylaldehyde, benzaldehyde, dimethoxybenzaldehyde and ethoxybenzaldehyde.

16. An antibacterial and deodorant processing method as claimed in claim 11, wherein said aromatic aldehyde is selected from the group consisting of anisaldehyde, salicylaldehyde, benzaldehyde, dimethoxybenzaldehyde and ethoxybenzaldehyde.

17. A disinfected and deodorized fabric or the individual threads thereof, each having a hydrophobic surface, produced by a process comprising treating the fabric or the individual threads thereof with a Schiff base derivative of an aminoglycoside antibiotic, wherein one or more amino groups of the aminoglycoside antibiotic is converted into a Schiff's base or a Schiff's base substituted with an N-alkyl group, wherein the fabric or the individual threads thereof are heated so as to allow said Schiff base derivative of an aminoglycoside antibiotic to diffuse into said fabric or the individual threads thereof, and then said fabric or the individual threads thereof are cooled so as to obtain said disinfected and deoderized fabric or the individual threads thereof.

* * * * *